United States Patent [19]

Kiriake

[11] Patent Number: 4,844,357

[45] Date of Patent: Jul. 4, 1989

[54] YARN KIND CHANGING PROCESS FOR A SPINNING WINDER

[75] Inventor: Masaharu Kiriake, Uji, Japan

[73] Assignee: Murata Kikai Kabushiki Kaisha, Kyoto, Japan

[21] Appl. No.: 147,172

[22] Filed: Jan. 22, 1988

[30] Foreign Application Priority Data

Jan. 28, 1987 [JP] Japan ..... 62-17880

[51] Int. Cl.[4] ..... B65H 54/00

[52] U.S. Cl. ..... 242/18 R; 242/35.5 R; 242/35.6 E; 57/267; 57/266

[58] Field of Search ..... 57/261, 266, 267, 268, 57/270; 242/35.5 R, 35.6 R, 35.6 E, 18 R, 18 EW, 18 PW

[56] References Cited

U.S. PATENT DOCUMENTS 3,398,906 8/1968 Bell ..... 242/35.6 E
4,660,780 4/1987 Otoshima ..... 242/35.6 E
4,723,720 2/1988 Matsui et al. ..... 242/35.6 E X
4,735,369 4/1988 Suzuki ..... 242/35.6 E X

*Primary Examiner*—Donald Watkins
*Attorney, Agent, or Firm*—Spensley, Horn, Jubas & Lubitz

[57] ABSTRACT

A yarn kind changing process for a spinning winder which comprises the steps of stopping winding of a bobbin being wound on a spinning spindle after a yarn kind changing instruction, cutting a sliver which extends between a draft part of a spinnig frame and a yarn supply station and joining a supply side sliver of a different kind to the sliver remaining on the draft part, starting the spindle again to wind yarn of the new kind on a layer of the yarn of the preceding kind on a winding bobbin, and removing the yarn of the new kind wound on the yarn of the preceding kind before the fully wound bobbin doffed from the spindle is subsequently supplied to a winder.

19 Claims, 4 Drawing Sheets

YARN KIND CHANGING PROCESS FOR A SPINNING WINDER

FIELD OF THE INVENTION

This invention relates to a yarn kind changing process for a spinning winder.

RELATED ART STATEMENT

While production of various kinds of yarn products in small quantities are requested rather than production of a single kind of products in a large quantity, a spinning winder wherein a spinning frame is connected to a winder for a next step has been brought into existence and is actually in operation. In particular, a bobbin produced on a spinning frame is supplied by way of a transport path directly to a winder at which yarn is unwound from the bobbin, and then the thus emptied bobbin is discharged from the winder and fed back to the spinning frame by way of a conveyor. In this manner, the bobbin is transported within a closed loop.

In such a system as described above, lot changing, that is, changing of a kind of yarn to be produced is effected comparatively frequently. Conventionally, such a yarn kind changing operation proceeds as follows.

In particular, when predetermined yarn is produced on a spinning frame, particularly on a ring spinning frame, bobbins fully wound on individual spindles of the spinning frame (such bobbins will be hereinafter referred to as spinning bobbins) are automatically transferred onto pegs of a transport band extending along the spindles after portions of yarn extending between the bobbins and draft parts have been cut by an operator. Slivers left on the draft parts are then removed by the operator, and sliver bobbins or sliver cans in which slivers are contained are replaced by slivers of another kind to be produced subsequently whereafter the new slivers are drawn out of the sliver bobbins and supplied to the draft parts. Then, spun yarn strings are drawn out and ends of such spun yarn strings are wrapped around empty bobbins on the spindles whereafter normal spinning operation is started.

Such a yarn kind changing operation as described above is normally performed by a manual operation of an operator which is a very complicated operation. This makes a cause of deterioration in working efficiency of the spinning frame itself where the spinning frame is constituted from a very large number of spindles up to several hundreds because a long time is required for preparation for changing of a yarn kind.

SUMMARY AND OBJECT OF THE INVENTION

It is an object of the invention to propose a process and a device whereby a yarn kind changing operation in a spinning winder can be simplified to a considerable degree and a working efficiency of a spinning winder can be raised substantially.

According to the present invention, there is provided a yarn kind changing process for a spinning winder which comprises the steps of stopping winding of a bobbin being wound on a spinning spindle after a yarn kind changing instruction, cutting a sliver which extends between a draft part of a spinning frame and a yarn supply station and joining a supply side sliver of a different kind to the sliver remaining on the draft part, starting the spindle again to wind yarn of the new kind on a layer of the yarn of the preceding kind on a winding bobbin, and removing the yarn of the new kind wound on the yarn of the preceding kind before the fully wound bobbin doffed from the spindle is subsequently supplied to a winder, the steps being carried out in the order in which they appear as above. With the yarn kind changing process of the present invention, only if an operator makes an operation of exchanging slivers to be supplied, changing of a yarn kind can be attained only by performing a normal doffing operation without removing remaining slivers on the draft parts and without the necessity of an operation of wrapping an end of yarn around an empty bobbin.

DESCRIPTION OF PREFERRED EMBODIMENTS

Now, embodiments of the present invention will be described with reference to the drawings.

Figure 2:
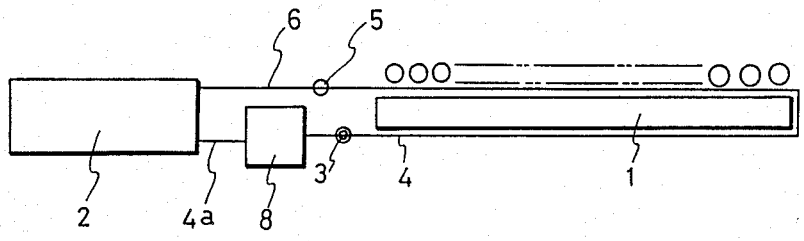
FIG. 2 a plan view showing an example of layout of a spinning winder.
Figure 4:
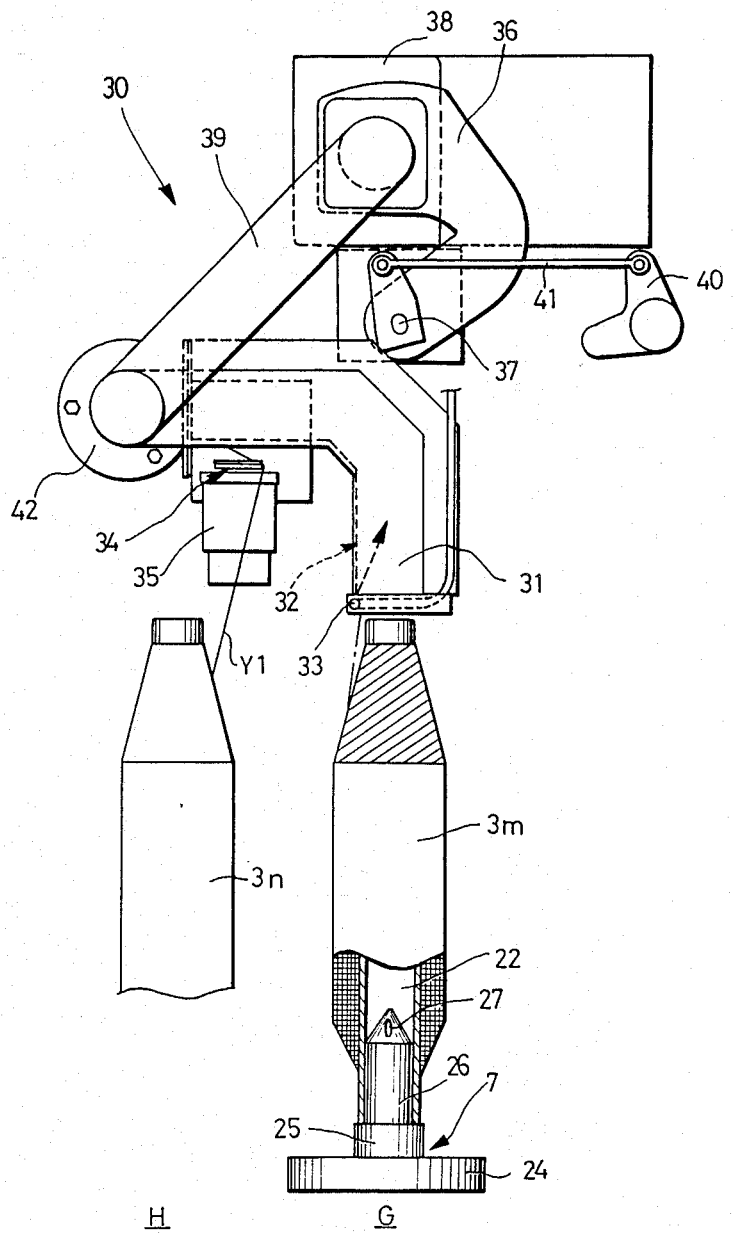

Referring to FIG. 2, an example of layout of a spinning winder is shown. A spinning frame 1 and a winder 2 are installed, and a closed loop is constituted by a spinning bobbin transport path 4 for transporting a spinning bobbin 3 produced on the spinning frame 1 to the winder 2 and an empty bobbin transport path 6 for feeding an empty bobbin 5 discharged from the winder back to the spinning frame. Thus, a spinning bobbin produced on the spinning frame is fitted uprightly onto such a tray 7, for example, as shown in FIG. 4 and transported and supplied together with the tray to any of winding units of the winder. In each winding unit, a spinning bobbin at an unwinding position is unwound and the thus emptied bobbin is discharged together with the tray and fed along the transport path 6. Thus, empty bobbins are placed in a juxtaposed relationship by a predetermined spindle pitch of the spinning frame. It is to be noted that a yarn end finding device 8 for finding an end of yarn of a spinning bobbin to be subsequently supplied to the winder is disposed intermediate the spinning bobbin transport path 4 of FIG. 2.

Figure 3:
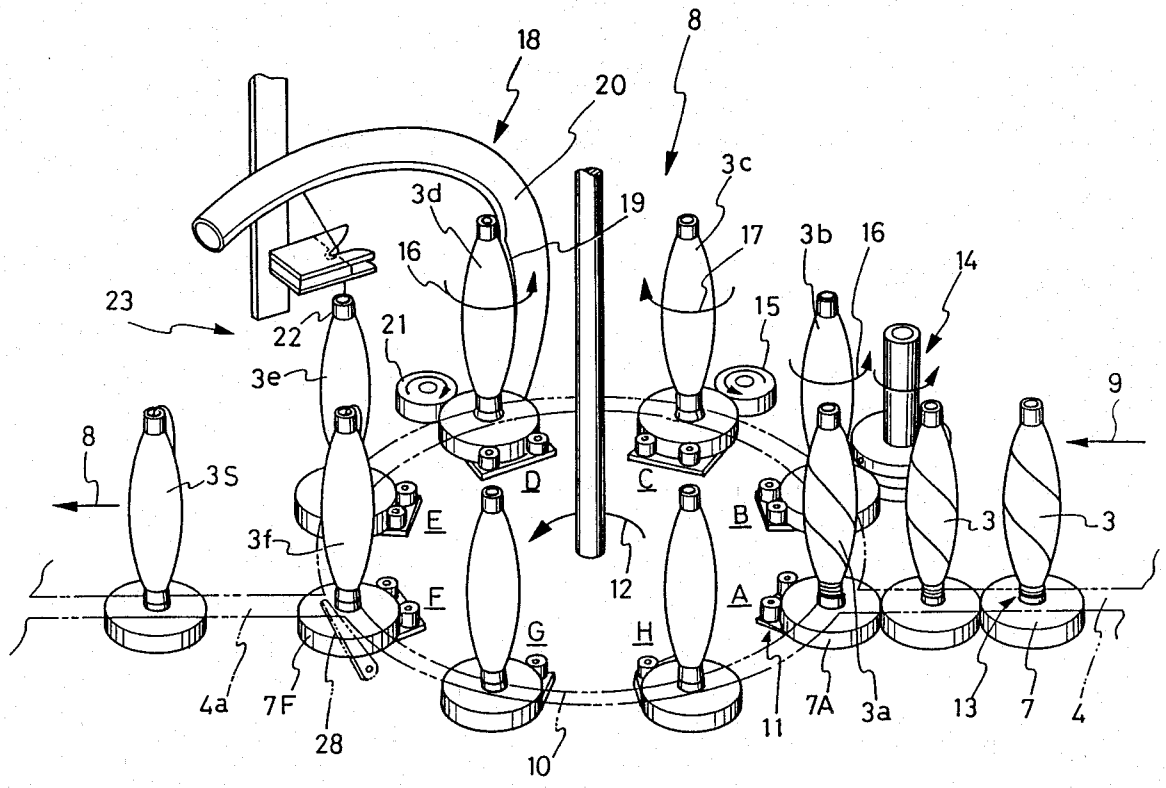
FIG. 3 a perspective view of general construction showing an example of yarn end finding device, FIG. 4 a front elevational view showing an example of mixed yarn removing device located at stations G and H of the yarn end finding device, FIG. 5 an illustrative view showing stations of the yarn end finding device of the FIG. 3 embodiment.

An example of the yarn end finding device is shown in FIG. 3.

It is to be noted that while in the present embodiment an example is shown which is applied to a case wherein a bunch winding is provided at a lower end portion of a spinning bobbin, the present embodiment can be applied to a bobbin having a top bunch thereon if some modification is made thereto.

A bobbin 3 produced on the spinning frame is fed in a direction of an arrow mark 9 along the transport path 4 to an accepting position A of the yarn end finding device while it is held fitted uprightly on a tray 7. The bobbin 3*a* which has been accepted by one of tray accepting portions 11 secured in a mutually spaced relationship by a predetermined pitch to a rotary plate 10 of the yarn end finding device passes one after another of processing stations B, C, D and E and finally comes to a discharging station F as the rotary plate 10 is rotated intermittently in a direction of an arrow mark 12. From the discharging station F, the bobbin 3S for which an end of yarn thereon has been successfully found is transported in a direction of an arrow mark 8 toward the winder along the transport path 7.

At the station B, a cutter device 14 for releasing and cutting a bunch winding 13 wrapped around a lower end portion of a bobbin is located while a roller 15 for drawing out a section of yarn extending between a bobbin 3C and the cutter 14 and wrapping it lightly on a surface of a layer of yarn on the bobbin is located at the station C. At the station B, a bobbin **3*b* is rotated by a friction roller in a direction of an arrow mark 16 in which yarn wound on the bobbin is to be released or unwound, and at the station C, a bobbin 3*c* is rotated by the roller 15 in a direction of an arrow mark 17 in which yarn is to be wound onto the bobbin 3*c*. Further at the station D, a yarn end sucking and releasing device 18 for sucking and releasing an end of yarn in a free condition is located. The yarn end sucking and releasing device 18 is constituted, for example, from a suction mouth 20 having a slit 19 therein. At the position, a bobbin 3*d* is rotated by a friction roller 21 in the direction of an arrow mark 16 in which yarn is to be released from the bobbin 3*d*. Further at the station E, a yarn end inserting mechanism 23 for cutting yarn drawn out of a bobbin into an end portion of a fixed length and inserting the yarn end portion into a center hole 22 of a bobbin 3*e***.

It is to be noted that a bobbin tray 7 in the present embodiment is comprised of a base member 24 in the form of a disk, and a stand portion 25 and a bobbin fitting peg 26 both formed in an integral relationship on the base member 24, and has a hollow formed in the inside thereof and opened at the bottom thereof. An air passing hole 27 is perforated in the peg 26. Thus, as the inside of the tray 7 is acted upon by a suction air flow, a sucking force acts in the center hole 22 via the air passing hole 27.

A tray 7A with a bobbin fitted uprightly thereon which has come to the accepting position A then passes the processing stations B to E by intermittent rotation of the rotary plate 10 by 45 degrees in the direction of the arrow mark 12, and then after it arrives at the discharging position F, the bobbin thereon is discharged onto a transport path **4*a* if an end of yarn thereon has been successfully found. On the contrary, if finding of an end of yarn on the bobbin has failed, the bobbin is hindered by a movable guide 28. Consequently, the bobbin then passes a bypass including stations G and H and comes again to the finding processing accepting position A in order to repetitively undergo such a sequence of processing operations as described above. In particular, a sensor for detecting a found end of yarn is located at the processing station E, and in case the sensor detects absence of a found end of yarn, the movable guide 28 shown in FIG. 3 is positioned by a rotary solenoid or a like means so that it may hinder a tray 7F arriving at the position F from being discharged onto the transport path 4*a***.

Further, at the bypass stations G and H, a mixed yarn removing device 30 shown in FIG. 4 for removing yarn of a different kind is located. In particular, located at the station G is a sucking pipe 31 for sucking and releasing an end of mixed yarn which depends from an upper end in the center hole of a bobbin which has arrived at the position G. The pipe extends above the station H and has a slit 32 formed therein. An opening of the pipe 31 is positioned on the center line of the bobbin and is capable of releasing an end of yarn by a sucking force thereof.

It is to be noted that reference numeral 33 of FIG. 4 denotes a nozzle for injecting compressed air toward the inside of the pipe 31, and the nozzle 33 assists sucking into the pipe 31 of an end of yarn depending from an upper end of a bobbin at the station G.

Further, a cutter 34 for cutting a section of yarn Y1 extending between the station H and the slit 32 of the sucking pipe 31 is located above the station H. The cutter 34 may be of a type wherein it comprised of a normal fixed blade and a movable blade which is operated by a driving source such as a motor or a rotary solenoid 35.

Further in FIG. 4, a shutter 36 for starting and stopping a sucking action of the sucking pipe 31 of the station G is mounted for pivotal motion around a shaft 37. The shutter 36 is mounted also for sliding movement between a sucking duct 38 and a pipe 39 and is opened and closed by a driving source not shown by way of a lever 40, a rod 41 and so on. The pipes 31 and 39 are connected to each other at a joint section 42.

Now, a yarn kind changing operation for the spinning winder including such a yarn end finding device as described above will be described. It is to be noted that while in the following description a sliver is used as yarn to be supplied, naturally it is possible to use a sliver bobbin for such supply yarn.

Figure 1:
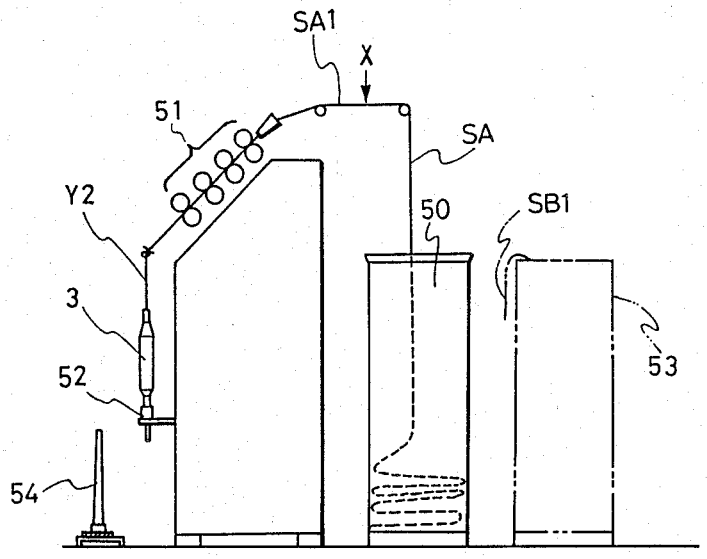
FIG. 1 is a side elevational view showing an example of spinning frame.

Referring to FIG. 1, just before production of a preset amount of yarn (of the kind a) on the spinning frame is completed, a yarn kind changing signal is delivered from a controlling device so that, for example, an alarming lamp located on a platform of the spinning frame is lit and spinning spindles are stopped once just before yarn is fully wound on bobbins thereon. In particular, in this condition, a sliver SA of the kind a drawn out of a sliver can 50 for the kind a extends to a draft part 51 while a section of yarn Y2 extends between the draft part 51 and a bobbin 3 on a spindle 52 as shown in FIG. 1. In this condition, an operator will cut the sliver at an arbitrary position X between the draft part 51 and the sliver can 50 and discharge the sliver can 50. After then, the operator will set another sliver can 53 in which a sliver of a different kind b is contained and will join an end section SB1 of the sliver on the can 53 side to an end SA1 of the sliver of the kind a at the cut position connecting to the draft part 51.

In this condition, the spindle 25 and the draft part 51 are started again. Thus, final production of the yarn of the kind a is completed when at least a portion of the sliver Sa of the kind a having stayed in the draft part 51 and a section of the sliver SB of the type b of a certain length are wound as a single string of yarn onto the bobbin 3. Subsequently, a normal doffing operation is carried out so that the spinning bobbin 3 on the spindle 52 is replaced by an empty bobbin 54 in a stand-by condition. Since yarn of the kind b is already produced and prepared for the empty bobbin thus set on the spindle, if a normal winding operation is then started again, the yarn of the kind b will be wound on the new empty bobbin without yarn of the kind a mixed therein.

In the meantime, the spinning bobbin doffed in this manner has a string of yarn of the type b of several meters wound at a final wound portion thereof. From the bobbin which has yarn of the different kind thereon, the mixed yarn of the different kind is removed on the yarn end finding device 8.

Figure 5:
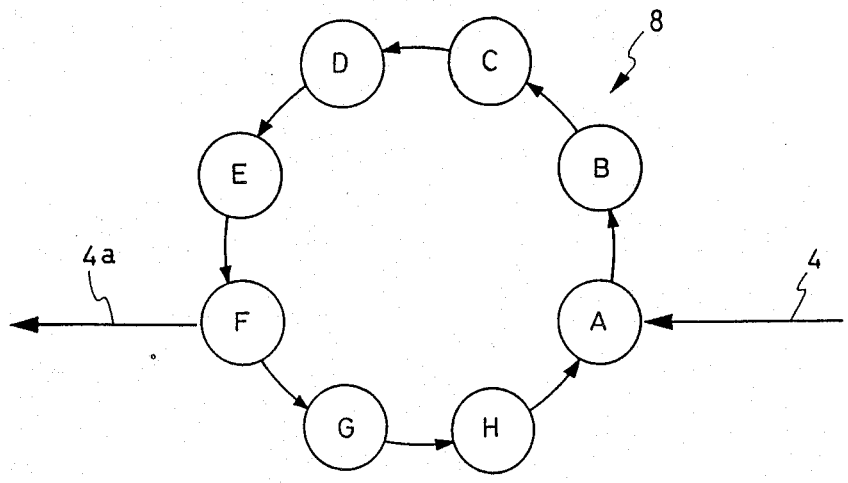
Figures 6A, 6B, 6C, 6D:
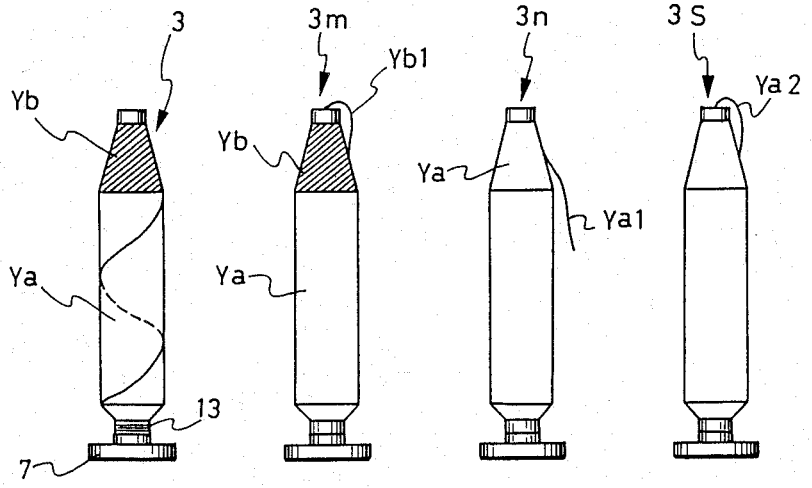
FIGS. 6A to 6D are views illustrating different steps of removing mixed yarn of a mixed yarn bobbin which may appear during a yarn kind changing operation.

Referring to FIG. 5 which illustratively shows only the stations A to H of the yarn end finding device 8 and also to FIGS. 6A to 6D illustrating conditions of an end of yarn, a spinning bobbin which is fed on the transport path 4 from the spinning frame to the yarn end finding device is in such a condition as shown in FIG. 6A wherein yarn Yb of the kind b is wound on a final portion of a layer Ya of yarn of the kind a which may be different depending on a type of traverse movement of a ring of the spinning frame while a bunch winding 13 is provided.

While the length of the mixed yarn string Yb of the bobbin is different depending upon settings of the conditions, count and winding time of yarn and so on, it ranges about 10 to 20 m. The bobbin 3 is transported in an integral relationship with a tray 7 and comes to the accepting station A of the yarn end finding device 8 whereafter it is fed along the stations A to E while normal yarn end finding processing is performed. Thus, the bobbin at the station E presents a condition in which an end section Ybl of the mixed yarn (of the kind b) is inserted and depends in the center hole of the bobbin. When the bobbin **3*m* comes to the station F, it is not discharged from but remains in the closed loop so that it then passes the stations G and H and is fed through the stations A to E again. In particular, when the bobbin 3m of FIG. 6B comes to the station G, the mixed yarn removing device 30 shown in FIG. 4 is rendered operative so that the section of yarn at the mixed yarn portion Yb is sucked and released. After lapse of a preset period of time, the bobbin 3*m* at the station G is fed to the station H at which a section Y1 of the yarn between the bobbin 3*n* and the pipe 31 is introduced into and cut by the cutter 34. Thus, at the station H, the bobbin 3*n* presents such a condition as shown in FIG. 6C** wherein it has a layer of the yarn of the kind a with the mixed yarn Yb removed therefrom and an end section Ya1 of the yarn is hung on a surface of the yarn layer thereon.

Further, the bobbin **3*n* undergoes yarn end finding processing similar to that for a normal bobbin while passing the stations A to E again. Consequently, at the station E, the bobbin 3S presents a condition as shown in FIG. 6D wherein it has only a layer of yarn of the kind a and an end section Ya2 of the yarn assumes a predetermined position or, in the present embodiment, is inserted and depends in the center hole of the bobbin. In this condition, the bobbin 3S is discharged from the station F onto the bobbin transport path 4*a*** on the winder side.

In this manner, yarn strings of a different kind wound on finally doffed bobbins for the kind a are removed so that the bobbins which have only layers of yarn of the kind a wound thereon are supplied to the winder.

It is to be noted that bobbins which are doffed at any time other than during the yarn kind changing operation are discharged from the station F of the yarn end finding device 8 after passing the stations A to E.

Accordingly, it is necessary to effect control of the movable guide 28 at the station F depending upon whether a bobbin is a normal bobbin or a mixed yarn bobbin. However, such control of the movable guide member 28 can be attained by making it possible to identify a mixed yarn bobbin from a normal bobbin by, for example, following means. In particular, an erasable and re-writable magnetic member is securely mounted on a tray 7, and for a tray on which a bobbin during yarn kind changing operation is fitted, information that a bobbin is a mixed bobbin and is different from any other bobbin is written on the magnetic member. Meanwhile, a reading device is located at the station F.

Further, it is necessary to make a discrimination whether or not a mixed bobbin has once passed the stations G and H. In this instance, control is such that if the reading device at the station F reads an identifying mark for the second time, the bobbin will be discharged, but when the reading device reads an identifying mark for the first time, the bobbin will not be discharged but be fed to the stations G and H. In this manner, the bobbins **3*m* and 3S of FIGS. 6B and 6D** can be identified from each other.

As apparent from the foregoing description, according to the present invention, operations at a spinning frame upon type changing over operation are simplified to a considerable degree. Accordingly, a time required for changing over of a type is reduced and the working efficiency of the spinning winder can be raised substantially.

What is claimed is:

1. A yarn kind changing device operable with a spinning bobbin having first and second lengths of yarn wound thereon, said yarn kind changing device further operable with a yarn end finding device having a bobbin accepting position, bobbin processing stations, a bobbin discharging position, a rotary plate rotatable intermittently adjacent the accepting position, processing stations, and discharging position, and bypass means for returning a bobbin to the bobbin accepting position, said yarn kind changing device comprising a first yarn removing station located along the bypass means, and a yarn moving device, located adjacent said first yarn removing station, for removing said second length of yarn from the spinning bobbin.

2. A yarn kind changing device as claimed in claim 1, further comprising a second yarn removing station located along the bypass means, wherein said yarn removing device comprises:

a sucking pipe for sucking and releasing an end of the second length of yarn, said sucking pipe having a slit extending to said second yarn removing station, a cutter for cutting a section of yarn extending between said second yarn removing station and the slit, and a shutter for starting and stopping a sucking action of the sucking pipe.

3. A yarn kind changing device as claimed in claim 2, further comprising a nozzle for injecting compressed air towards the inside of the sucking pipe.

4. A yarn kind changing device as claimed in claim 2, further comprising:

a reading device, located between the bobbin accepting and discharging positions, for making a discrimination whether or not a bobbin having first and second lengths of yarn; and a movable guide arranged adjacent the bobbin discharging position, said movable guide being movable to a first position to guide a bobbin to the bypass means.

5. A yarn kind changing device as claimed in claim 1, wherein the first length of yarn is a first kind of yarn and the second length of yarn is a second kind of yarn which is different from the first kind of yarn.

6. A yarn kind changing device as claimed in claim 1, wherein said yarn kind changing device is further operable with a yarn processing device and wherein the second length of yarn comprises a starter length of yarn drawn through the yarn processing device to load the yarn processing device with yarn.

7. A yarn changing device as claimed in claim 6, wherein the yarn processing device comprises a yarn spinning unit.

8. A yarn kind changing device as claimed in claim 6, wherein the first length of yarn is a first kind of yarn and the second length of yarn is a second kind of yarn which is different from the first kind of yarn.

9. A bobbin processing system operable on a bobbin having a first length of a first type of yarn and a second length of a second type of yarn, said system comprising:

yarn removing means for removing a length of yarn from the bobbin; and control means for controlling the yarn removing means to remove the second length of yarn from the bobbin.

10. A bobbin processing system as claimed in claim 9, wherein said control means comprises preset means for presetting the length of yarn which the yarn removing means removes to encompass the second length of the second type of yarn.

11. A bobbin processing system as claimed in claim 9, wherein said yarn removing means comprises a suction means operable for sucking yarn from the bobbin.

12. A bobbin processing system as claimed in claim 11, wherein said suction means comprises:

a suction passage through which a suction force is communicable;

a shutter arranged to selectively traverse the suction passage and selectively obstruct communication of the suction force.

13. A bobbin processing system as claimed in claim 12, wherein said control means comprises shutter control means for selectively controlling the shutter to traverse the suction passage.

14. A bobbin processing system as claimed in claim 13, wherein said control means further comprises timing control means, having a preset time period, for controlling the selective operation of the shutter to traverse the suction passage following the lapse of said preset time period.

15. A bobbin processing system as claimed in claim 12, wherein:

said suction passage comprises a first pipe having a first opening and a second pipe having a second opening arranged in communication with and spaced from said first opening; and said shutter comprises a movable plate movable in the space between said first and second openings.

16. A bobbin processing system as claimed in claim 15, further comprising moving means operable for moving said movable plate between a first position obstructing communication between said first and second openings and a second position accommodating communication between said first and second openings.

17. A bobbin processing system as claimed in claim 16, wherein said control means comprises:

timing means for timimg the operation of the suction means, said timing means having a preset time period;

moving control means, responsive to said timing means, for controlling the operation of said moving means to move said movable plate from said second position to said first position after the lapse of said preset time period timed by said timing means during operation of said suction means.

18. A bobbin processing system as claimed in claim 9, wherein said yarn removing means has a bobbin receiving position and said bobbin processing device further comprises transporting means for transporting the bobbin to and from said bobbin receiving position, said transporting means comprising:

a first bobbin path having a bobbin input end, a bobbin output end and at least one bobbin processing station located between said input and output ends; and a second bobbin path having a bobbin input end arranged adjacent said bobbin output end of said first bobbin path, said second bobbin path having a bobbin output end arranged adjacent said bobbin input end of said first bobbin path, wherein said bobbin receiving position of said yarn removing means is provided adjacent said second bobbin path between input and output ends of said second bobbin path.

19. A bobbin processing system as claimed in claim 18, further comprising:

yarn end finding means operable for finding an end of the yarn wound about on the bobbin, said yarn end finding means located adjacent said at least one bobbin processing station;

detecting means for detecting whether the bobbin has the second length of the second type of yarn thereon; said detecting means being arranged adjacent said first bobbin path; and transfer means, responsive to said detecting means detecting the second length of the second type of yarn, for transferring the bobbin from said output end of said first bobbin path to said input end of said second bobbin path.

* * * * *